US011358851B1

(12) United States Patent
Gardner et al.

(10) Patent No.: US 11,358,851 B1
(45) Date of Patent: Jun. 14, 2022

(54) GANGED RESERVOIR SYSTEM

(71) Applicant: Mercury Plastics LLC, Middlefield, OH (US)

(72) Inventors: Scott Raymond Gardner, Chagrin Falls, OH (US); Earl Christian, Jr., Chagrin Falls, OH (US); Donald Currey, Chagin Falls, OH (US)

(73) Assignee: Mercury Plastics LLC, Middlefield, OH (US)

( * ) Notice: Subject to any disclaimer, the term of this patent is extended or adjusted under 35 U.S.C. 154(b) by 0 days.

(21) Appl. No.: 16/457,953

(22) Filed: Jun. 29, 2019

Related U.S. Application Data

(60) Provisional application No. 62/692,321, filed on Jun. 29, 2018.

(51) Int. Cl.
*B67D 1/00* (2006.01)
*B67D 1/08* (2006.01)
*F25D 23/12* (2006.01)

(52) U.S. Cl.
CPC ..... *B67D 1/0009* (2013.01); *B67D 1/0801* (2013.01); *F25D 23/126* (2013.01); *B67D 2001/0818* (2013.01)

(58) Field of Classification Search
CPC ..... B67D 1/0801; B67D 2001/0818; B67D 1/0009; F25D 23/126
USPC ..... 137/263, 265, 266, 571
See application file for complete search history.

(56) References Cited

U.S. PATENT DOCUMENTS

| | | | | |
|---|---|---|---|---|
| 2,731,027 | A * | 1/1956 | Daun | B67D 1/0832 137/170.1 |
| 3,722,538 | A * | 3/1973 | Gezari | E03D 11/11 137/588 |
| 9,297,575 | B1 * | 3/2016 | Gardner | F25D 23/126 |
| 2014/0230481 | A1 * | 8/2014 | Yun | B67D 1/0894 62/340 |
| 2015/0210523 | A1 * | 7/2015 | Witte | B29D 22/003 222/394 |

* cited by examiner

*Primary Examiner* — Angelisa L. Hicks
(74) *Attorney, Agent, or Firm* — Bose McKinney & Evans LLP

(57) ABSTRACT

Examples herein relate generally to reservoirs for use in water distribution systems within an appliance. The reservoir herein allows for the combination of various components prepared by separate manufacturing processes and for reducing waste of those manufacturing components. Specifically, the reservoir herein provides a daisy-chain structure for forming a ganged reservoir system.

14 Claims, 18 Drawing Sheets

GANGED RESERVOIR SYSTEM

CROSS-REFERENCE TO RELATED APPLICATIONS

This application claims priority to, and the benefit of, U.S. Provisional Application No. 62/692,321 filed on Jun. 29, 2018 with the United States Patent Office, which is hereby incorporated by reference.

BACKGROUND

It is known to provide dispenser units within refrigerators, or other appliances, in order to enhance the accessibility to ice and/or water. Typically, such a dispenser unit will be formed in the freezer door of a side-by-side style refrigerator or in the fresh food or freezer door of a top mount style refrigerator. In either case or even in another location, a water line will be connected to the refrigerator in order to supply the needed water for the operation of the dispenser. For use in dispensing the water, it is common to provide a water tank within the fresh food compartment to act as a reservoir such that a certain quantity of the water can be chilled prior to being dispensed.

Certain dispenser equipped appliances available on the market today incorporate blow molded water tanks which are positioned in the fresh food compartments of the appliance, such as a refrigerator. More specifically, such a water tank is typically positioned in the back of the fresh food compartment, for example, behind a crisper bin or a meat keeper pan so as to be subjected to the cooling air circulating within the compartment. Since the tank is typically not an aesthetically appealing feature of the appliance, it is generally hidden from view by a sight enhancing cover.

For certain other dispenser equipped appliances, the reservoir may be molded, for example, by a process disclosed in U.S. Pat. No. 7,850,898, in which a heated extrudate is positioned in a mold followed by insertion of previously extruded profiles that are inserted into the beginning and end apertures of the main extrudate body. The mold is closed and pressure applied through the inserted profiles to expand the main extrudate body to fill the mold cavity, forming an essentially leak-proof seal between the extrudate body and the inserted profiles.

A molded reservoir requires significant set-up and manufacturing effort. What is needed is an improved reservoir and reservoir system that incorporate pre-manufacture or separately manufactured components which may be ganged together, or daisy-chained, with new and improved fittings or connections.

SUMMARY

The present disclosure described herein relates to a new reservoir and reservoir system for use in a water distribution system. What is disclosed herein is a reservoir useful in an appliance water dispensing system comprising one or more of the features hereinafter fully described and particularly pointed out in the claims. The following description and the annexed drawings set forth in detail certain illustrative embodiments, being indicative of but a few of the various ways in which the principles of the present disclosure may be employed.

In one example, a ganged reservoir system for use in a water distribution system within an appliance is disclosed, the ganged reservoir system comprising:

a first container in fluid communication with a second container, each container including a vessel structure terminating at a neck around an opening;

a cap sealingly engaging the neck of each container, the cap comprising:

an inlet fitting and an outlet fitting;

an inlet tube attached to the inlet fitting of the cap of the first container;

an outlet tube attached to the outlet fitting of the cap of the second container;

where the outlet fitting of the cap of the first container attaches to the inlet fitting of the cap of the second container.

In another example, a daisy-chain structure for connecting a first container and a second container to form a ganged reservoir system within an appliance is disclosed, the daisy-chain structure comprising:

at least a first cap and a second cap, the first cap configured to attach the first container and the second cap configured to attach to the second container, each of the first cap and the second cap comprising:

an inlet fitting and an outlet fitting;

where the outlet fitting of the cap of the first container attaches to the inlet fitting of the cap of the second container.

The foregoing and other objects, features, and advantages of the examples will be apparent from the following more detailed descriptions of particular examples, as illustrated in the accompanying drawings wherein like reference numbers represent like parts of the examples.

BRIEF DESCRIPTION OF THE DRAWINGS

Reference is made to the accompanying drawings in which particular examples and further benefits of the examples are illustrated as described in more detail in the description below, in which.

DETAILED DESCRIPTION

As used in this application, the term "overmold" means the process of injection molding a second polymer over a first polymer, wherein the first and second polymers may or may not be the same. An overmold having a specific geometry may be necessary to attach a tube to a fitting, valve, another tube, a diverter, a manifold, a fixture, a T connector, a Y connector or other plumbing or appliance connection. In one embodiment, the composition of the overmolded polymer will be such that it will be capable of at least some melt fusion with the composition of the polymeric tube or fitting. There are several means by which this may be affected. One of the simplest procedures is to insure that at least a component of the polymeric tube or fitting and that of the overmolded polymer is the same. Alternatively, it would be possible to ensure that at least a portion of the polymer composition of the polymeric tube or fitting and that of the overmolded polymer is sufficiently similar or compatible so as to permit the melt fusion or blending or alloying to occur at least in the interfacial region between the exterior of the polymeric tube or fitting and the interior region of the overmolded polymer. Another manner in which to state this would be to indicate that at least a portion of the polymer compositions of the polymeric tube or fitting and the overmolded polymer are miscible. In contrast, the chemical composition of the polymers may be relatively incompatible, thereby not resulting in a material-to-material bond after the injection overmolding process.

Figure 1:
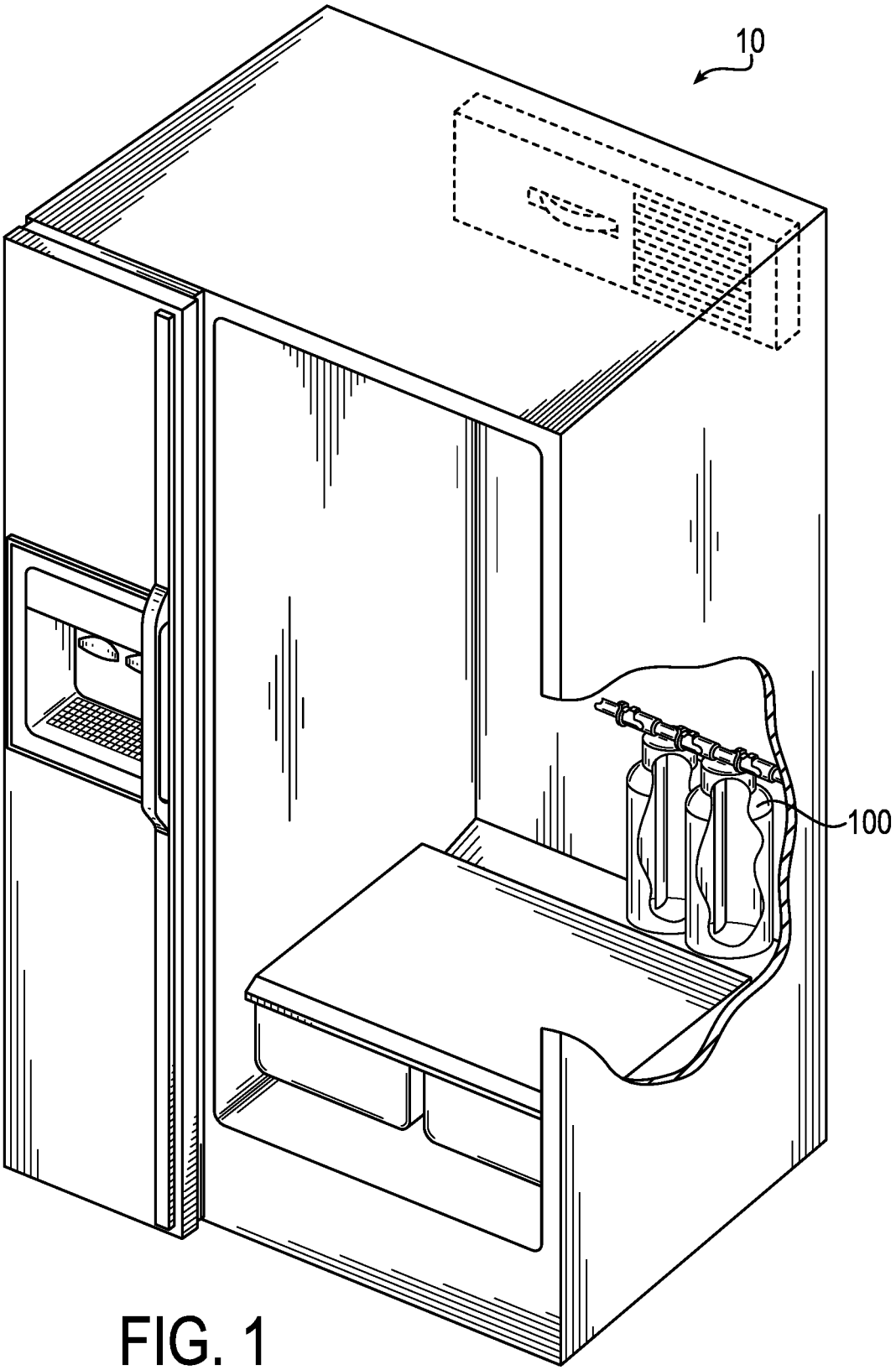
FIG. 1 is a partial perspective view of an appliance showing a diagrammatical cutaway view of a reservoir of the present disclosure.

Referring now to FIG. 1, an appliance 10 having a water dispensing system is shown. A reservoir 100 of the present disclosure is illustrated within the appliance 10. The reservoir 100 is a combination of separately manufactured components. The ability to combine, or gang together, separately manufactured components improves manufacturing availability, manufacturing lead-times, manufacturing set-up, and reduces manufacturing costs. Also, by separately manufacturing the components of the reservoir and utilizing the fittings of the present disclosure, the reservoir of the present disclosure provides different reservoir configurations or systems compatible with different appliances, while maintaining or reusing one or more manufacturing components, processes, or systems across the various configurations.

Figure 2:
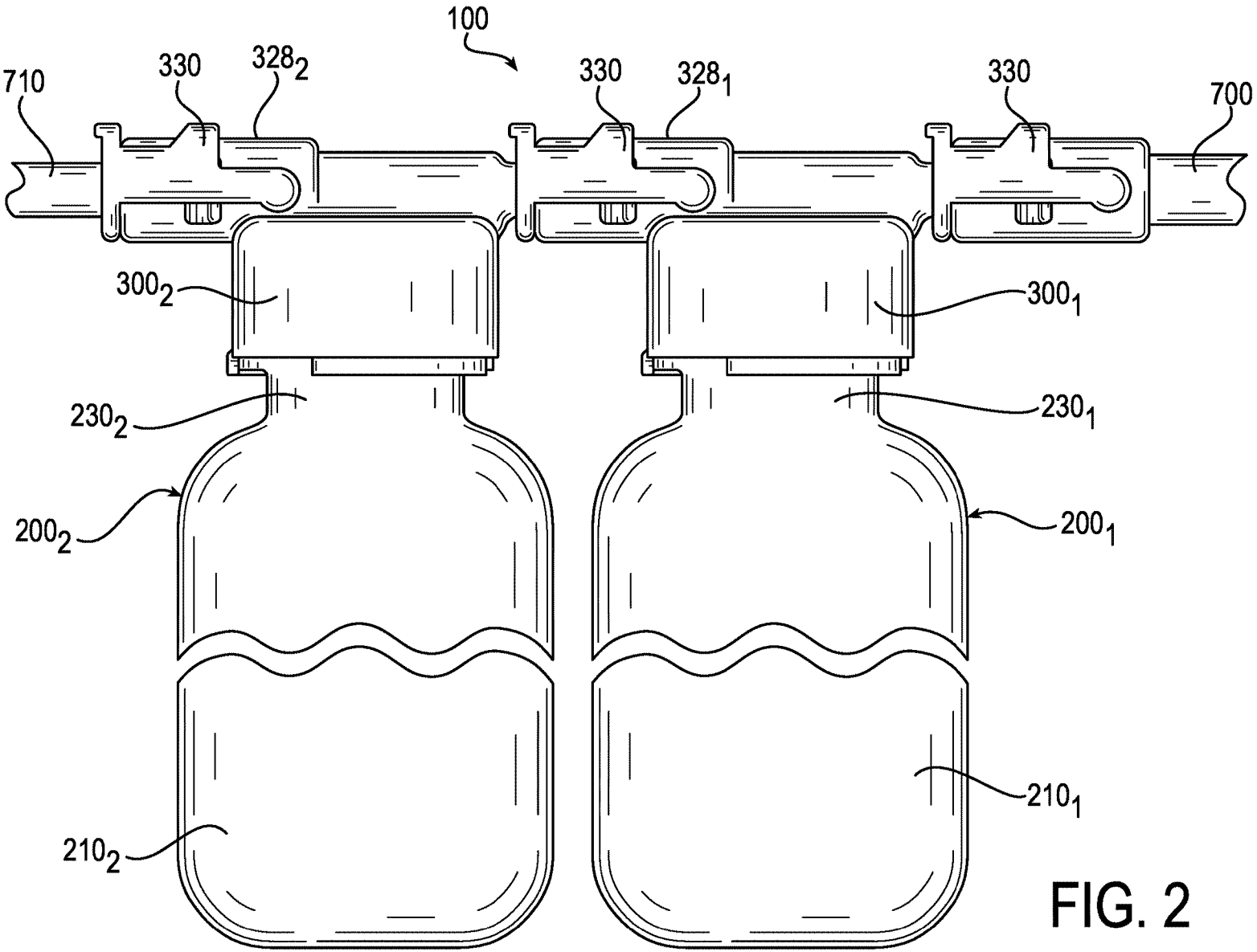
FIG. 2 is a side view of the reservoir shown in FIG. 1.
Figure 3:
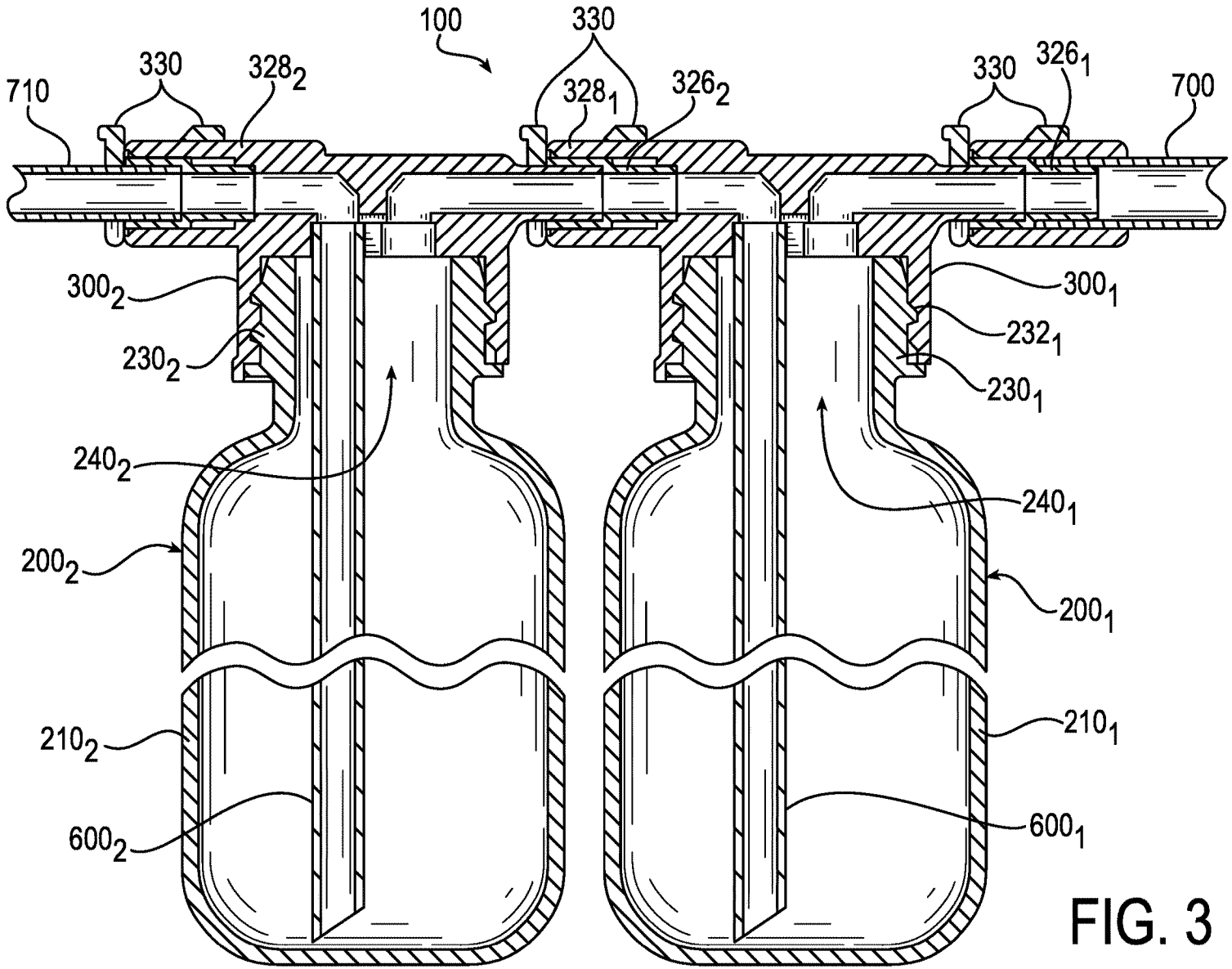
FIG. 3 is a cross-sectional view of the reservoir shown in FIG. 1.
Figure 4:
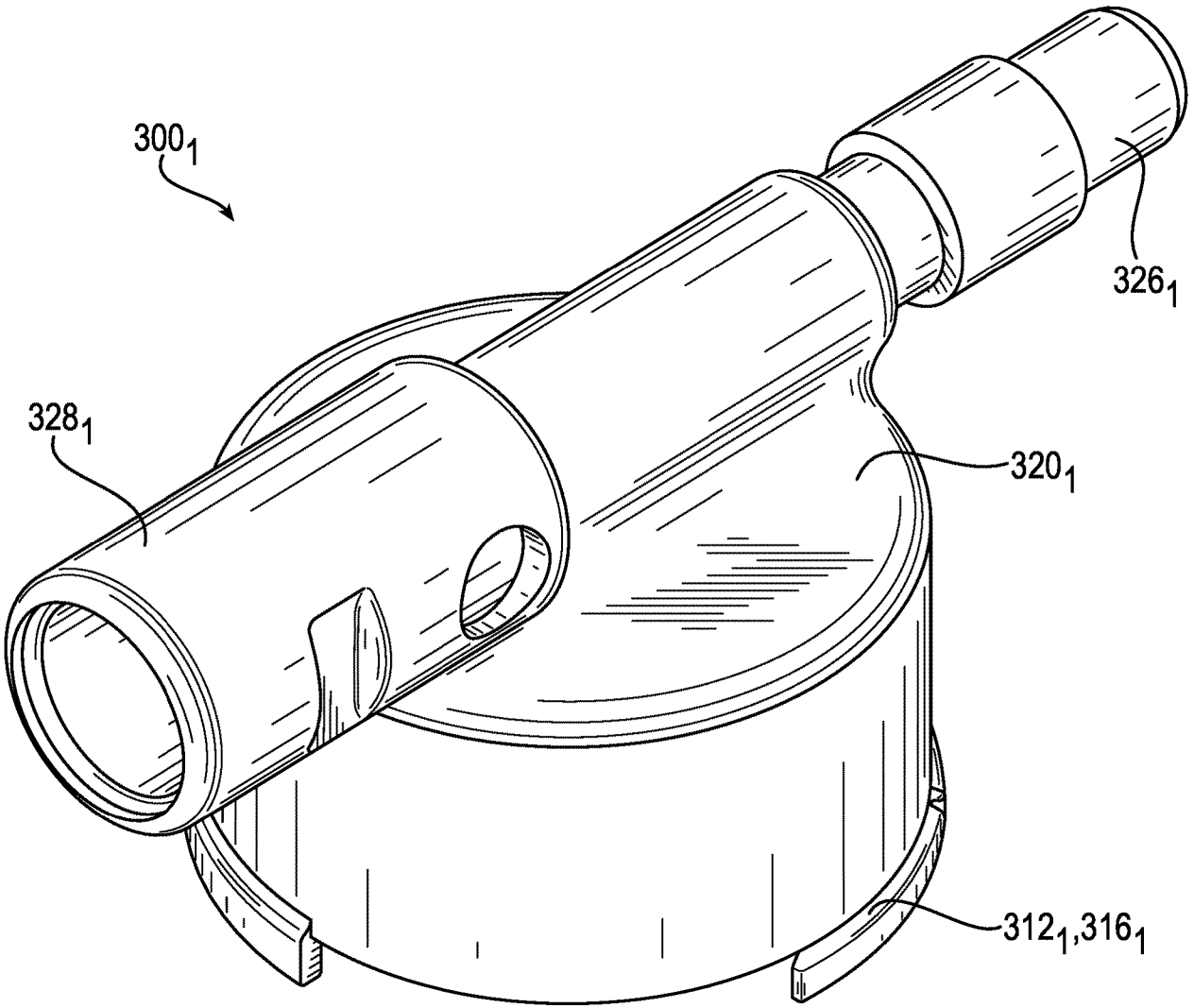
FIG. 4 is a top perspective view of a cap forming part of the reservoir shown in FIG. 1.

With reference to FIGS. 2-3, the reservoir 100 of the present disclosure comprises a first container $\mathbf{200}_1$ and a second container $\mathbf{200}_2$. A container will be described with particular reference to the first container $\mathbf{200}_1$. However, it is understood herein that the features, or a variation of the features, of the first container may be found on the second container and/or additional containers forming the water dispensing system. As illustrated the first container $\mathbf{200}_1$ comprises a vessel structure $\mathbf{210}_1$ terminating at a neck $\mathbf{230}_1$ around an opening $\mathbf{240}_1$. The container further comprises a cap $\mathbf{300}_1$ that is attached to the neck $\mathbf{230}_1$.

Figure 5:
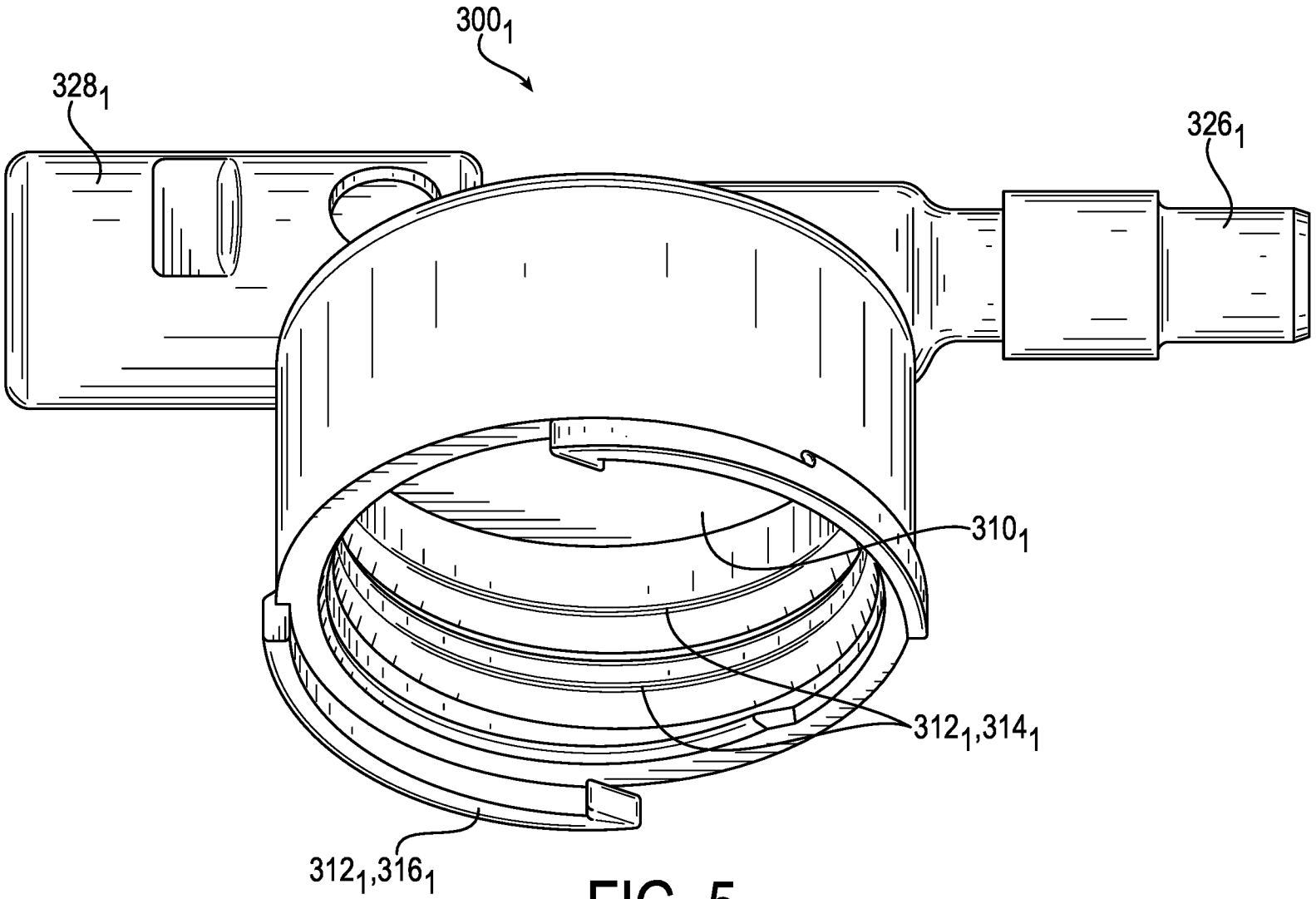
FIG. 5 is a bottom perspective view of a cap forming part of the reservoir shown in FIG. 1 disassembled.
Figure 6:
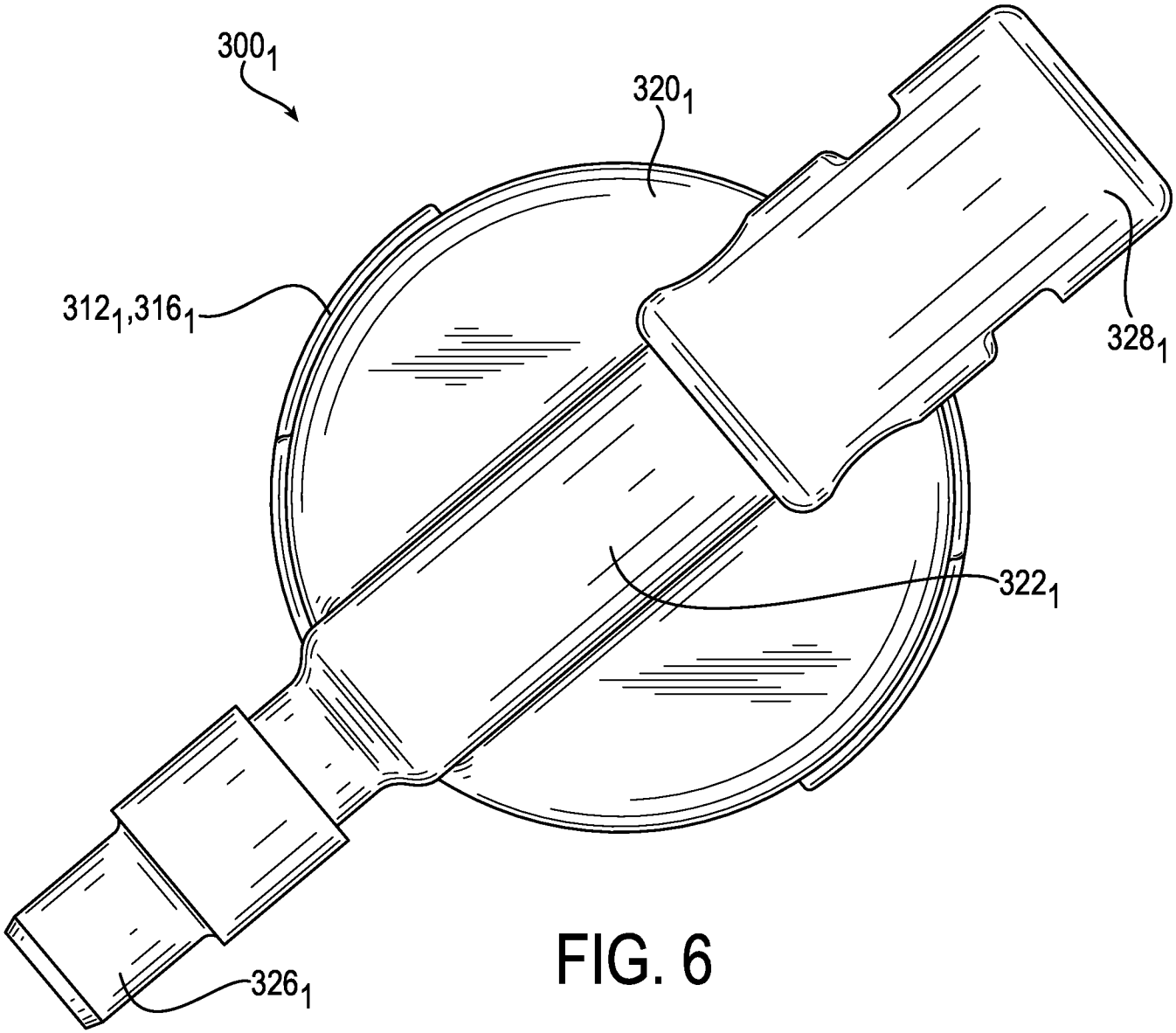
FIG. 6 is a top view of a cap forming part of the reservoir of FIG. 1.
Figure 7:
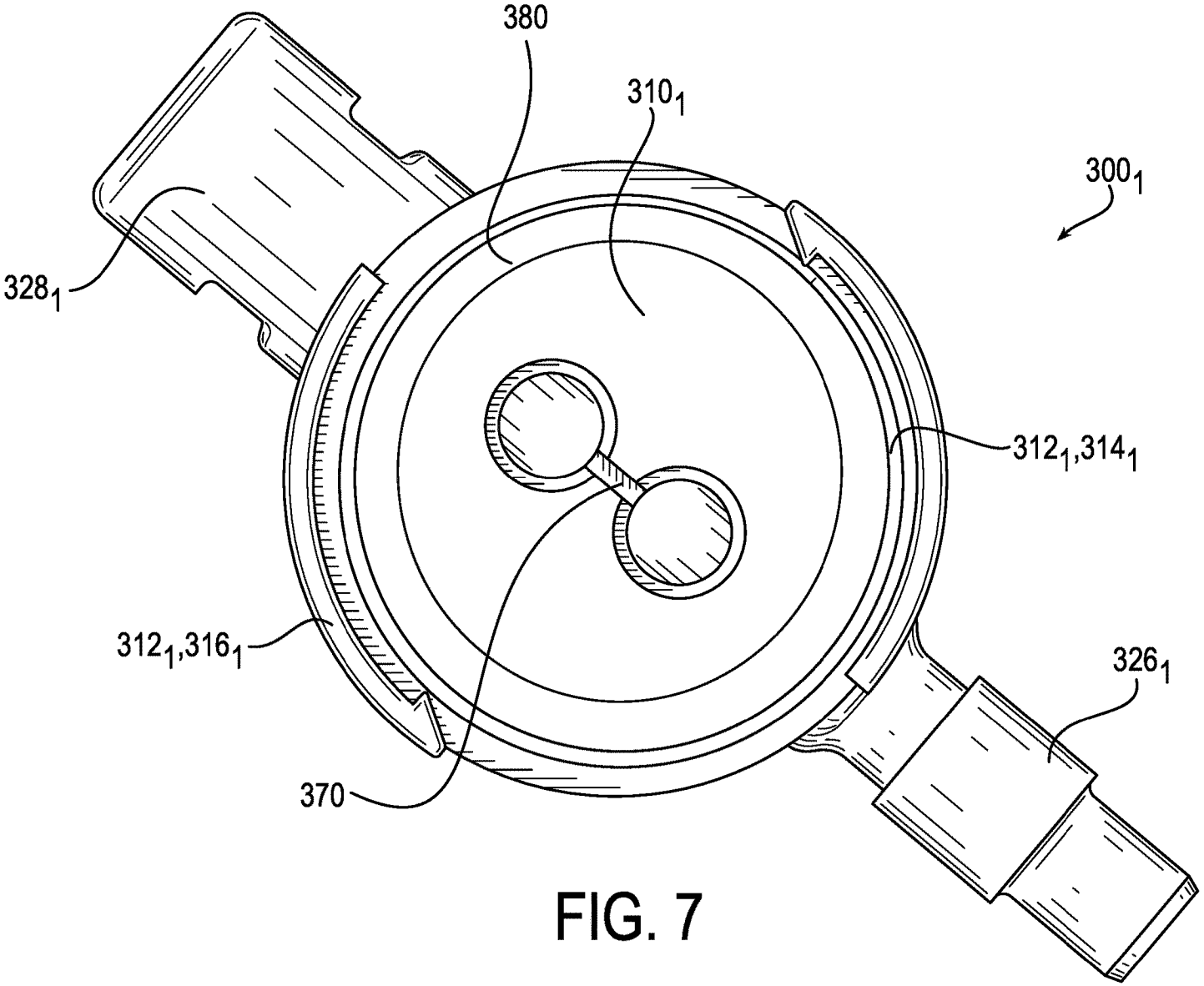
FIG. 7 is a bottom view of a cap forming part of the reservoir of FIG. 1.
Figure 8:
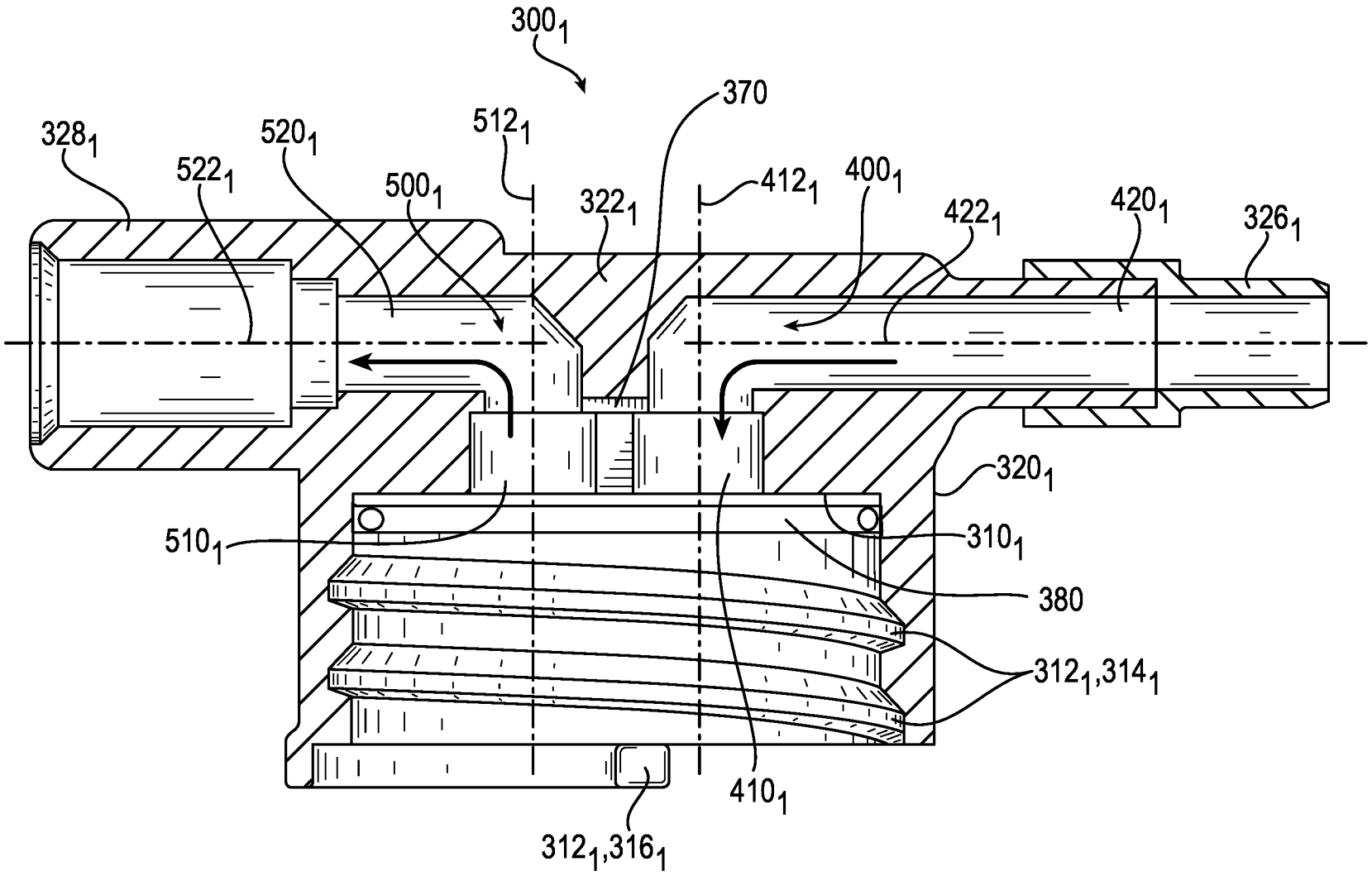
FIG. 8 is a cross-sectional view of a cap forming part of the reservoir of FIG. 1.
Figure 9:
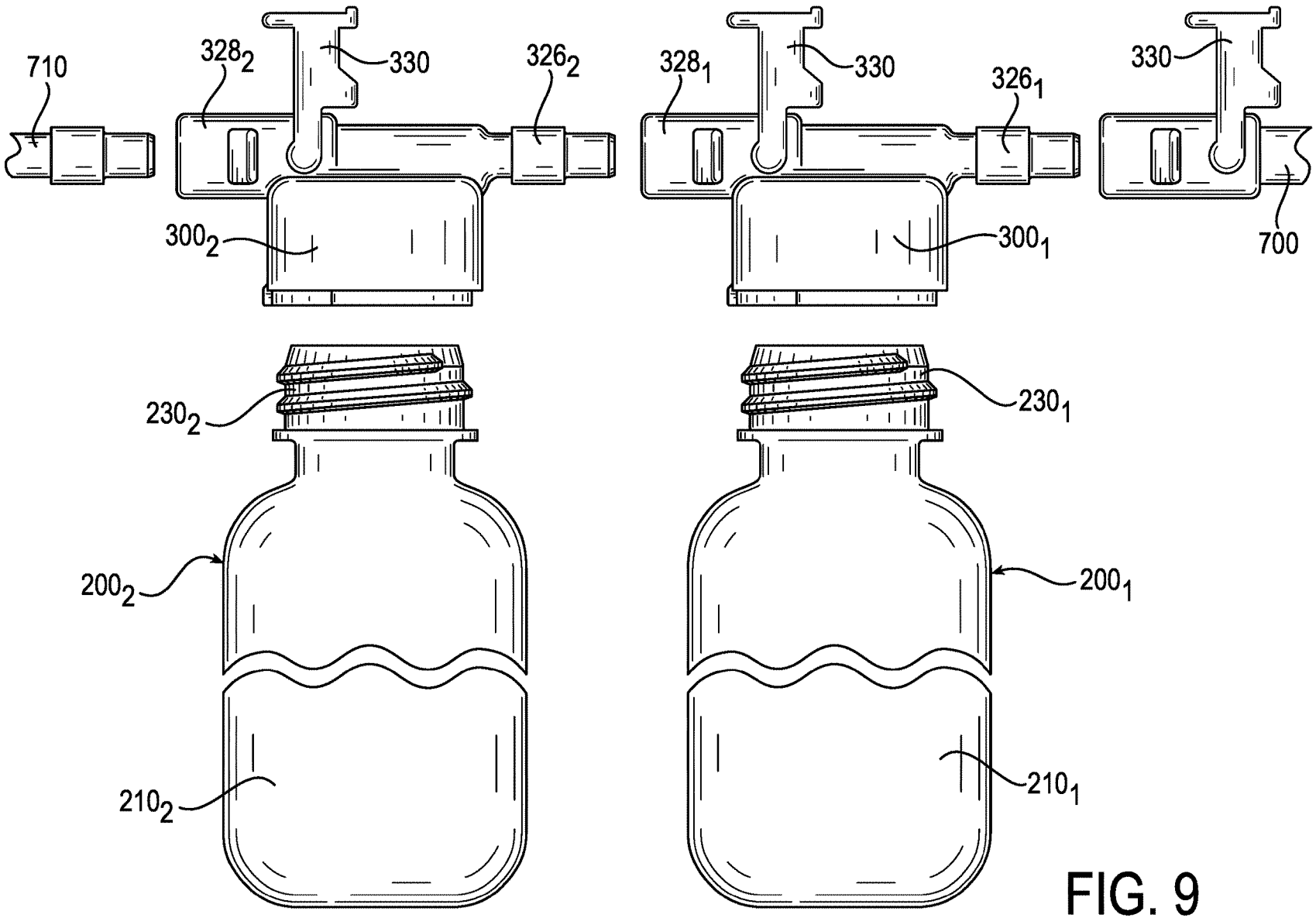
FIG. 9 is a side view of the reservoir shown in FIG. 1 disassembled.
Figure 10:
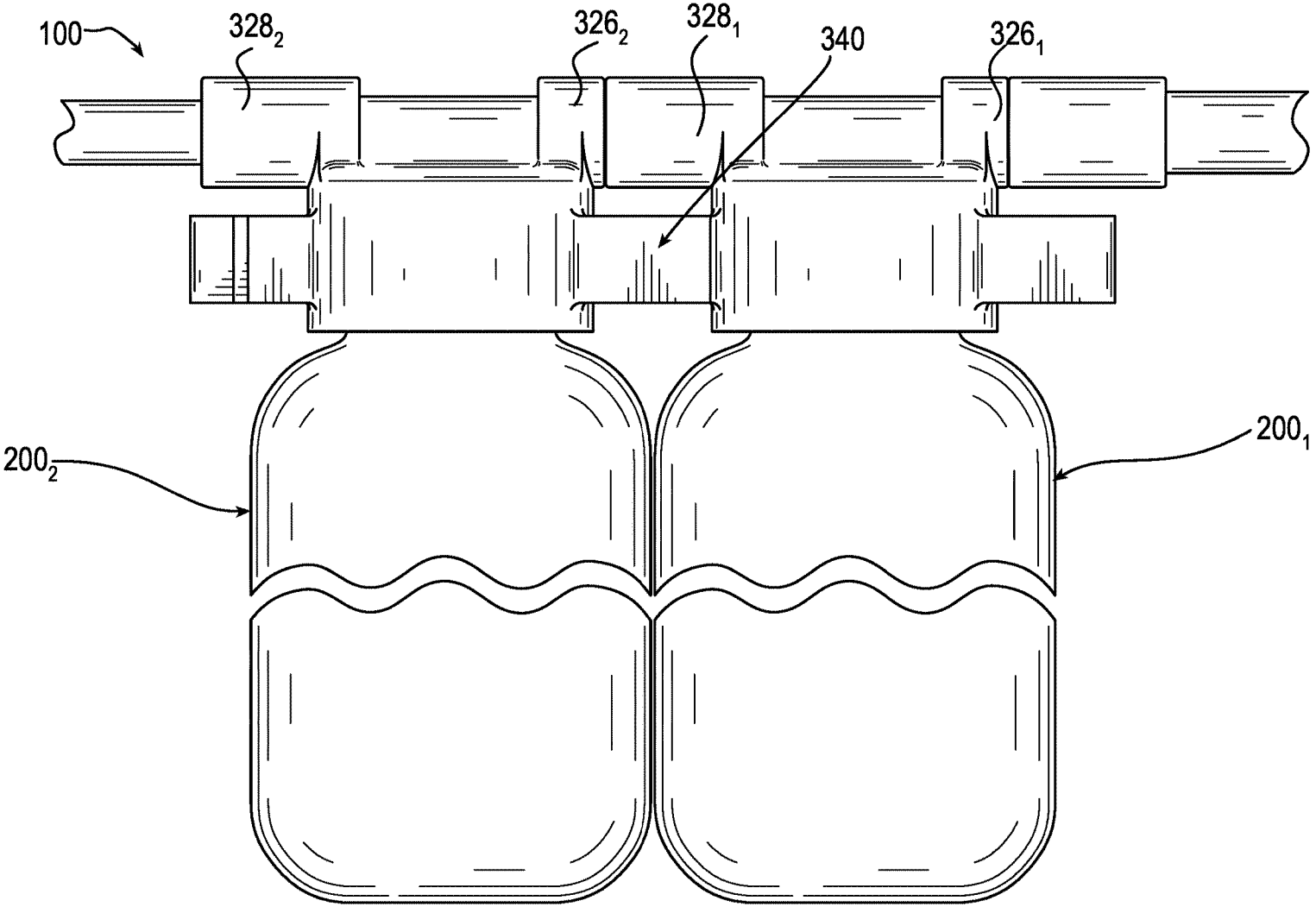
FIG. 10 is a side view of the reservoir shown in FIG. 1 partially disassembled.
Figure 11:
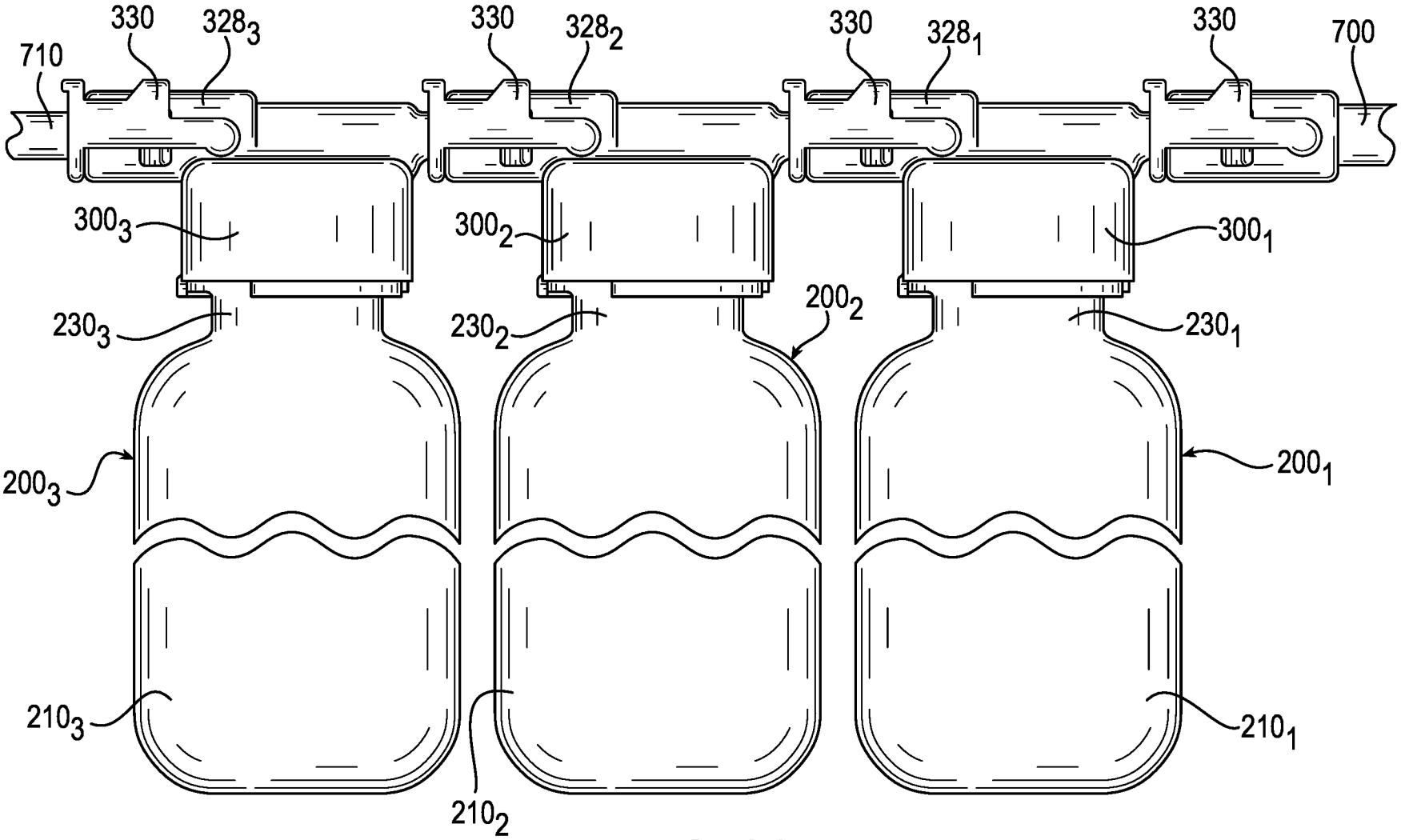
FIG. 11 is a side view of a reservoir having three vessels with exemplary components as described with respect to FIG. 1.

In the example as illustrated by FIGS. 2-3, a first cap $\mathbf{300}_1$ is attached to the first container $\mathbf{200}_1$ and a second cap $\mathbf{300}_2$ is attached to the second container $\mathbf{200}_2$. Like the container described above, a cap will be described with particular reference to the first cap $\mathbf{300}_1$. However, it is understood herein that the features, or a variation of the features, of the first cap may be found on a second cap and/or additional caps, corresponding to additional containers, forming a water distribution system. The first cap $\mathbf{300}_1$ is attached to the neck $\mathbf{230}_1$ of the vessel structure $\mathbf{210}_1$. In specific examples, the cap $\mathbf{300}_1$ sealingly engages with the neck $\mathbf{230}_1$ at an internal surface $\mathbf{310}_1$ (as illustrated by FIGS. 5 and 7-8) of the cap $\mathbf{300}_1$. As illustrated by FIGS. 5 and 7-8, the internal surface $\mathbf{310}_1$ comprises a sealing structure $\mathbf{312}_1$ for forming a leak-proof connection between the neck $\mathbf{230}_1$ of the vessel structure $\mathbf{210}_1$ (as illustrated by FIGS. 2-3). As illustrated by FIG. 8, one example of a sealing structure $\mathbf{312}_1$ is threads $\mathbf{314}_1$ and another example of a sealing structure $\mathbf{312}_1$ is a ratcheting connection $\mathbf{316}_1$. One or both may be used with the reservoir herein. Returning to FIG. 3, the neck $\mathbf{230}_1$ includes corresponding threads $\mathbf{232}_1$ for mating with threads $\mathbf{314}_1$. The leak-proof connection is formed between the neck $\mathbf{230}_1$ and the cap $\mathbf{300}_1$ such that the contents of the vessel structure $\mathbf{210}_1$ may only transfer from the vessel structure $\mathbf{210}_1$ through the opening $\mathbf{240}_1$ and cap $\mathbf{300}_1$. As illustrated by FIG. 8, this fluid transfer may be accomplished by way of a container inlet $\mathbf{410}_1$ and a container outlet $\mathbf{510}_1$, each extending through a cap inlet $\mathbf{420}_1$ and a cap outlet $\mathbf{520}_1$, respectively. Such a leak-proof connection may occur, for example, as a result of friction, by use of seals (e.g. gaskets, o-rings, or the like), overmolding, adhesive, a combination thereof, etc. For example, an o-ring 380 is inserted into the underside of the cap 300 as illustrated in FIGS. 7-8 to form a leak-proof connection between the cap 300 and the container 200. Other methods for sealingly engaging the cap 300 to the neck 220 are contemplated herein, by example, a ratcheting connection, a friction connection, a barbed connection, a combination thereof, or the like. In some examples, the cap may be permanently attached to the neck of the vessel structure by permanent connections disclosed herein and understood in the art, examples of those being overmolding, adhesive, welding, a combination thereof, or the like. The components of the reservoir, as described herein, may be repeatedly assembled and/or disassembled, may be reused or recycled for addition to other reservoirs, may be modified, or the like. By example, FIG. 9 illustrates a disassembled reservoir, with components as previously described with respect to FIGS. 2-3. In yet another example, FIG. 10 illustrates a partially disassembled reservoir with the tubes 700, 710 and fittings $\mathbf{328}_1$, $\mathbf{328}_2$, $\mathbf{326}_1$, $\mathbf{326}_2$ disassembled and the caps $\mathbf{300}_1$, $\mathbf{300}_2$ assembled, with additional components as previously described with respect to FIGS. 2-3. Alternatively, some or all of the components as described herein may be permanently assembled.

With particular reference to FIG. 8, the cap $\mathbf{300}_1$ comprises a container inlet $\mathbf{410}_1$, a container outlet $\mathbf{510}_1$, a cap inlet $\mathbf{420}_1$, and a cap outlet $\mathbf{520}_1$, each facilitating the transfer of fluids through the reservoir system. As illustrated by FIG. 8, a container inlet axis $\mathbf{412}_1$, a container outlet axis $\mathbf{512}_1$, a cap inlet axis $\mathbf{422}_1$, and a cap outlet axis $\mathbf{522}_1$ are provided, as a reference, to illustrate the orientation and for further defining of each of the container inlet, the container outlet, the cap inlet, and the cap outlet, relative to one another. In one example, the container inlet axis $\mathbf{412}_1$ is parallel to the container outlet axis $\mathbf{512}_1$. Additionally or alternatively, the cap inlet axis $\mathbf{422}_1$ and the cap outlet axis $\mathbf{522}_1$ are coaxial. Additionally or alternatively, the container inlet axis $\mathbf{412}_1$ may be transverse to the cap inlet axis $\mathbf{422}_1$. In one example, the container inlet axis $\mathbf{412}_1$ is substantially perpendicular to the cap inlet axis $\mathbf{422}_1$. Additionally or alternatively, the container outlet axis $512_1$ may be transverse to the cap outlet axis $522_1$. In one example, the container outlet axis $512_1$ is substantially perpendicular to the cap outlet axis $522_1$. As used herein, substantially perpendicular includes angles that are additionally oblique and are within five degrees of being perpendicular.

In the examples illustrated by FIGS. 2-8, the cap $300_1$ further comprises an external surface $320_1$. The external surface $320_1$ is opposite the internal surface 310. In one example, as shown in FIG. 8, the inlet fitting $326_1$ and the outlet fitting $328_1$ are integral or a one-piece connection on the cap by way of a cap fitting structure $322_1$ (illustrated by FIGS. 6 and 8). Each fitting may be of the same configuration, such as a unisex arrangement, and/or opposite mating configuration, such as a male arrangement and a female mating arrangement, for connecting to another fitting and/or component. The mating arrangements may be further secured by a securing structure, such as a clip, threads, through bolt, adhesive, or the like. Examples of a clip connection, or quick-connect tube coupling, are found in U.S. Pat. No. 9,103,478 for a Quick-Connect Tube Coupling, which is herein incorporated by reference. A quick-connect tube coupling 330 is illustrated by FIGS. 2-3 and 9-11. In one specific example, the inlet fitting $326_1$ is a male fitting and the outlet fitting $328_1$ is a female fitting, or vice versa. The fittings $326_1$, $328_1$ may be integral with the cap or separate components. In one example, either one or both fittings $326_1$, $328_1$ are overmolded onto the cap.

Figure 12:
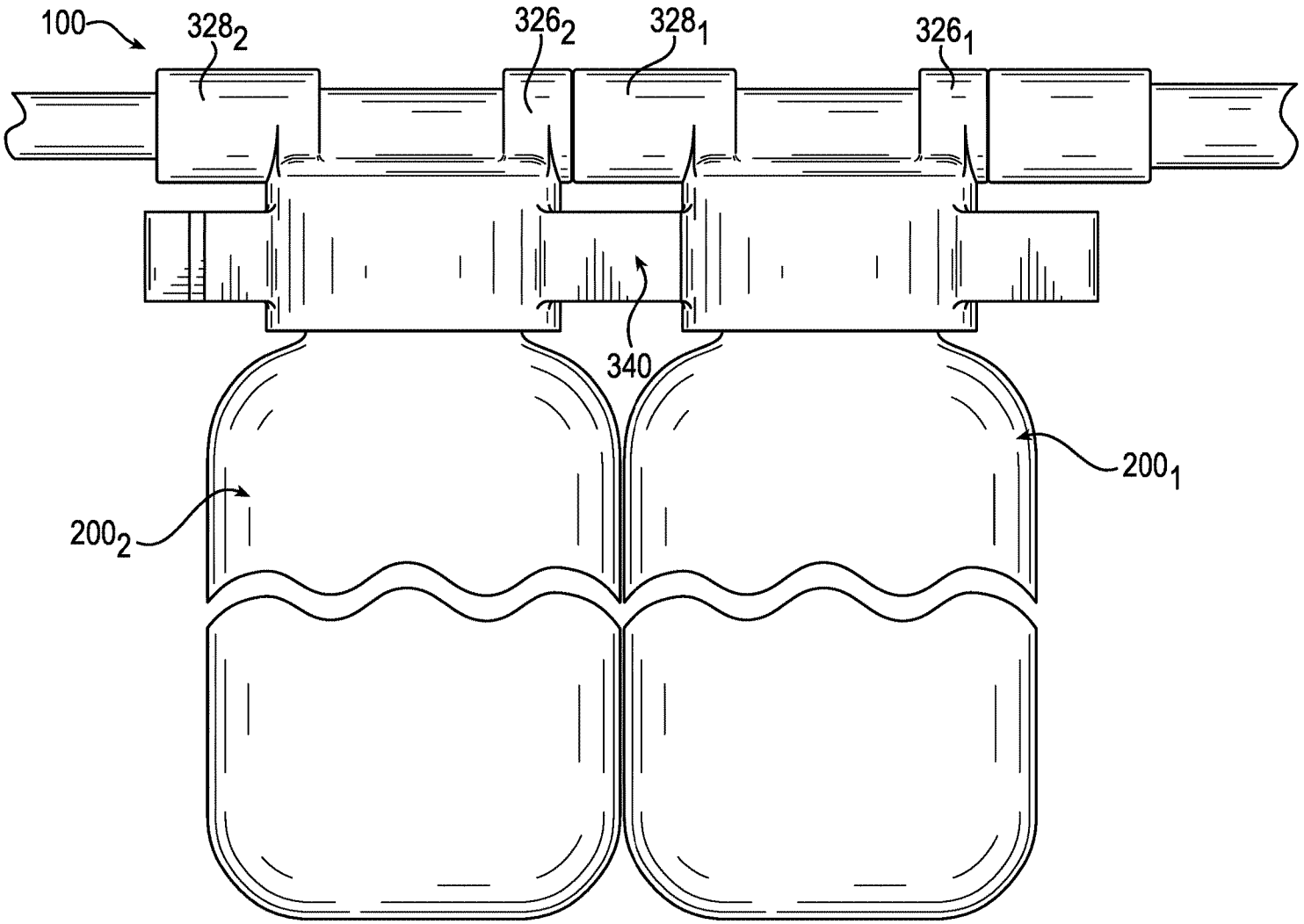
FIG. 12 is a side view of a reservoir having a clip securing structure.
Figure 13:
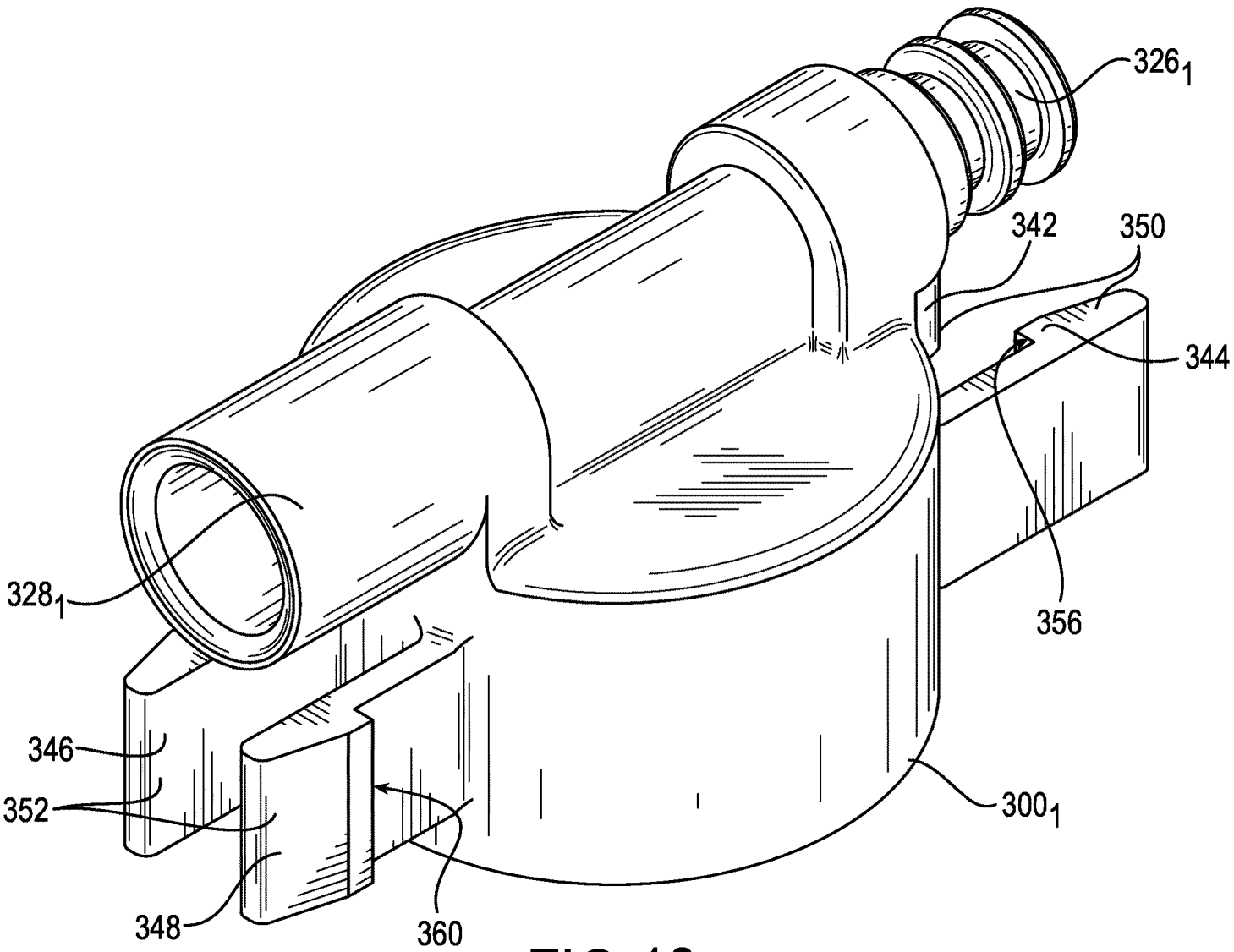
FIG. 13 is a top perspective view of a cap have a clip securing structure forming a part of the reservoir of FIG. 12.
Figure 14:
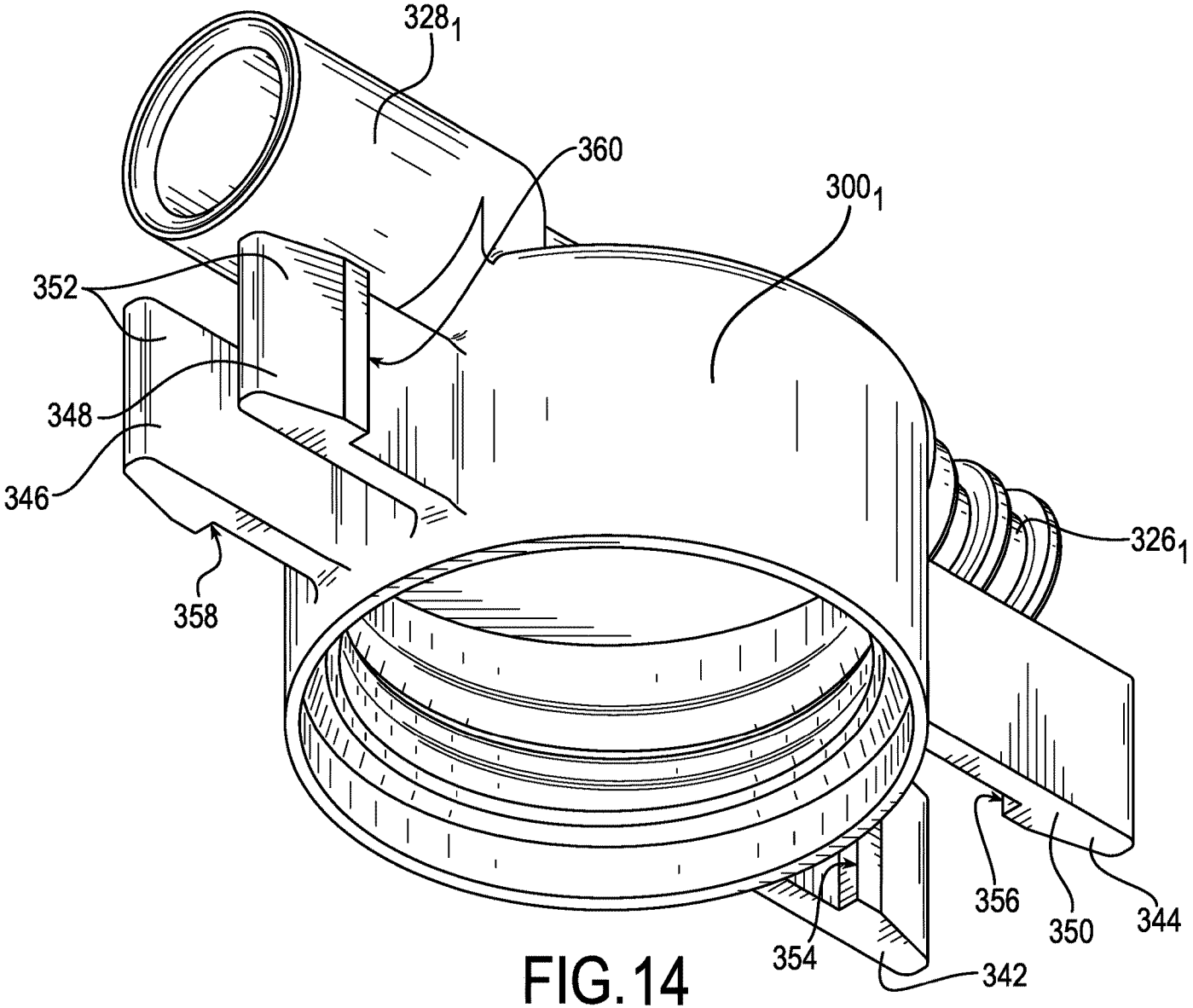
FIG. 14 is a bottom perspective view of a cap having a clip securing structure forming a part of the reservoir of FIG. 12.

In another example of a securing structure, FIG. 12 illustrates a clip securing structure 340. With specific reference to FIGS. 13-14, the clip securing structure 340 is formed by one or more tabs 342, 344, 346, 348 at opposing sides of the cap $300_1$, (with the first cap $300_1$ being described as an exemplary example wherein the features of the first cap $300_1$ are additionally representative of the second cap $300_2$ and/or additional caps (not illustrated)). In the example of FIGS. 12-16, the one or more tabs 342, 344, 346, 348 extend outwardly from the cap $300_1$ and are located below the fittings $326_2$, $328_1$. The one or more tabs 342, 344, 346, 348 may be aligned beneath the respective corresponding fittings $326_2$, $328_1$ as seen in FIGS. 13-14. Specifically, when secured with an adjacent cap, the one or more tabs provide additional support to the ganged reservoir system 100, above and beyond any connections between an inlet fitting $326_2$ and an outlet fitting $328_1$. In FIGS. 13-14, a pair of the one or more tabs, being tabs 342, 344, form a female structure 350 for receiving and connecting to a corresponding opposing pair of the one or more tabs, being tabs 346, 348, that form a male structure 352. In this particular example, the tabs further comprise lips 354, 356, 358, and 360. At the female structure 350, the lips 354, 356 face inwardly, and the lips 358, 360 of the male structure 352 face outwardly. Each tab is flexibly resilient such that they may slide over corresponding tabs of the adjacent caps until the lips are engaged and clip together in an opposing mating relationship between the female structure 350 and the male structure 352 to secure a first cap $300_1$ to a second cap $300_2$, as illustrated by FIG. 12, and thus also secure the first container $200_1$ to the second container $200_2$. When connecting, the tabs 346, 348 of the male structure 352 engage the tabs 342, 344 of the female structure 350 by flexing until the respective lips 354, 356, 358, 360 lock in place. This occurs as the inlet fitting $326_2$ correspondingly engages the outlet fitting $328_1$, as illustrated by FIG. 12. To disassemble the containers $200_1$, $200_2$ and/or caps $300_1$, $300_2$, the tabs 342, 344 of the female structure 350 are expanded to release the tabs 346, 348 of the male structure 352.

Figure 15:
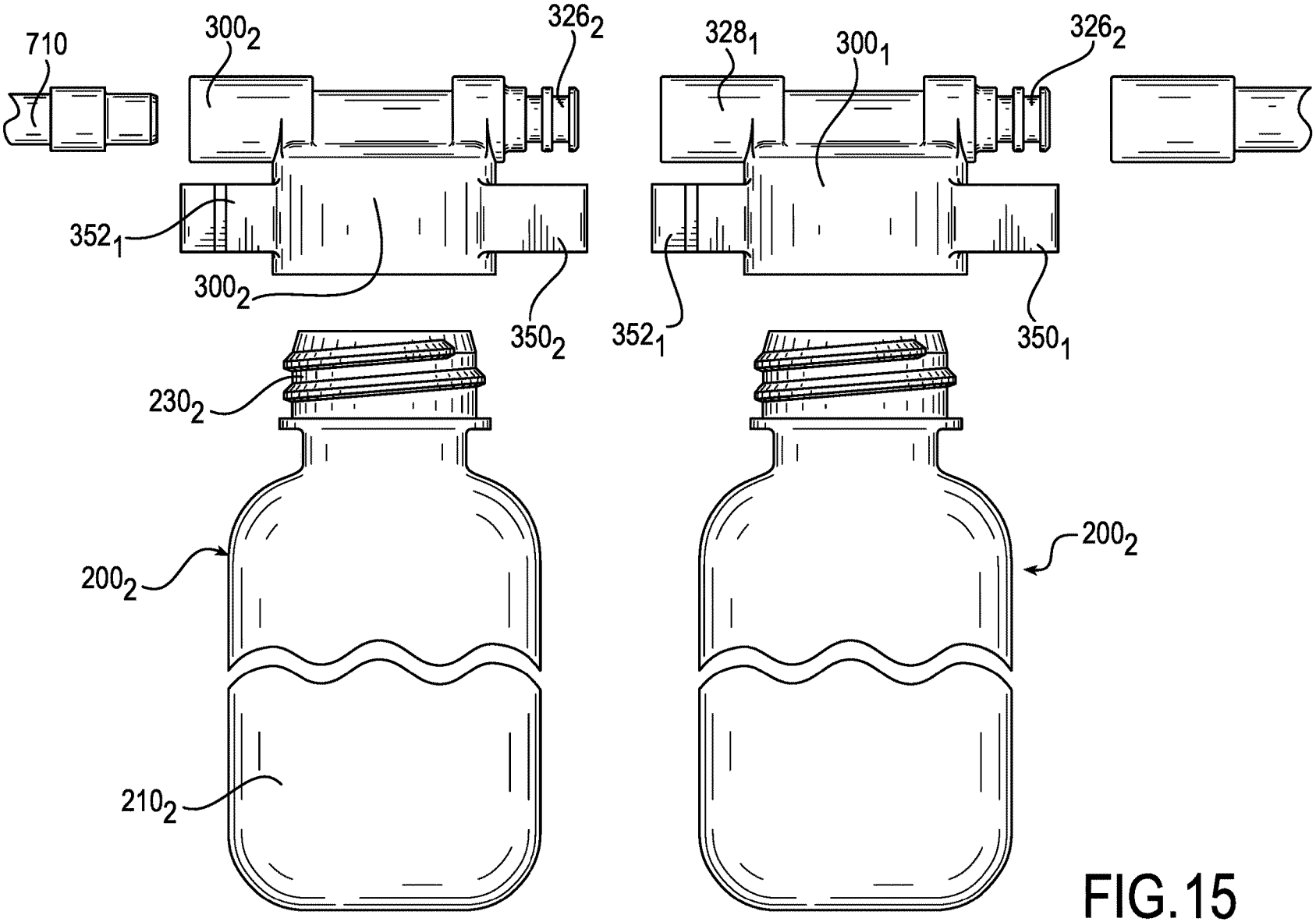
FIG. 15 is a side view of the reservoir shown in FIG. 12 disassembled.
Figure 16:
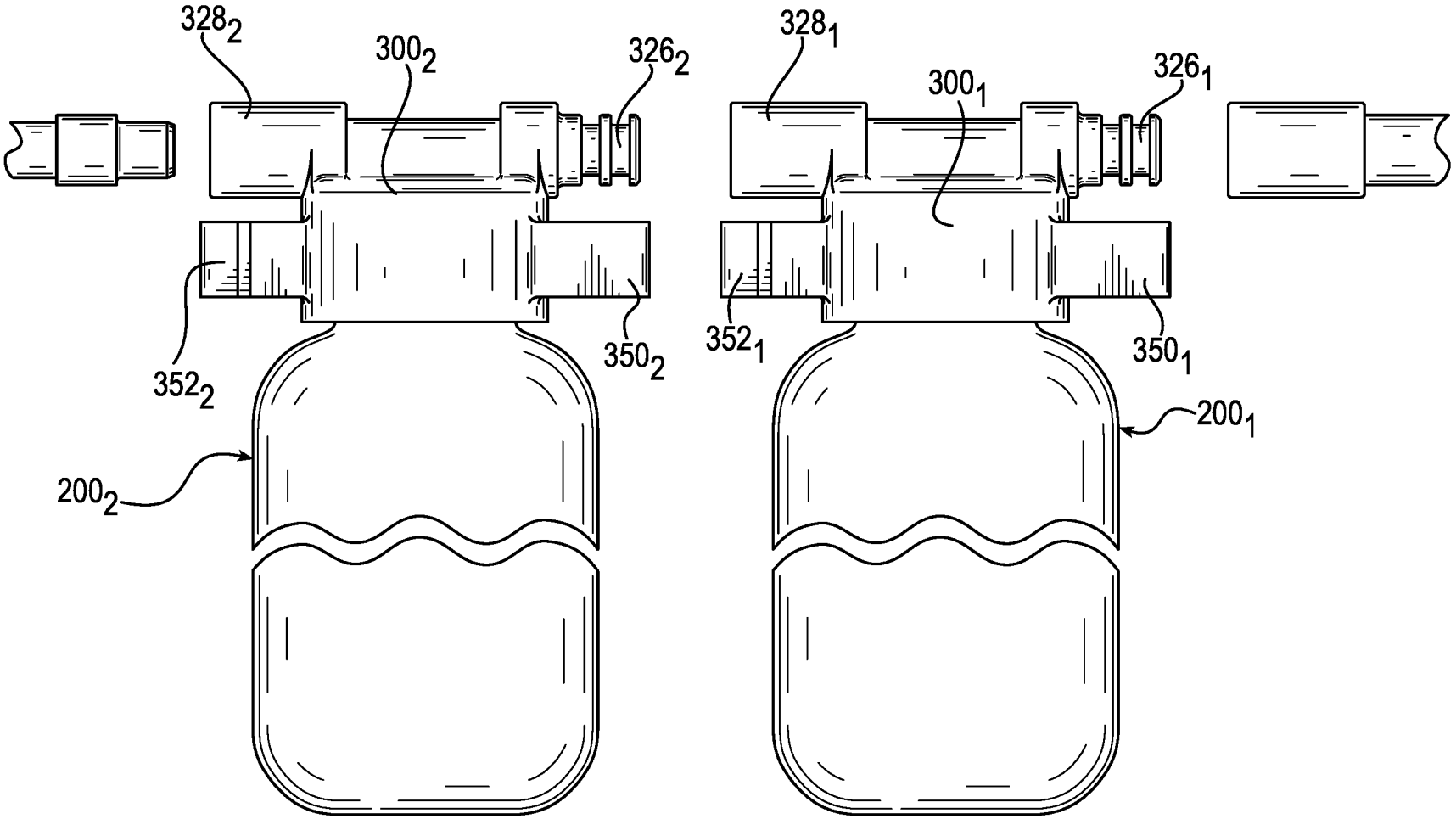
FIG. 16 is a side view of the reservoir shown in FIG. 12 partially disassembled.

FIG. 15 further illustrates a disassembled reservoir with the clip securing structure 340. FIG. 16 illustrates a partially disassembled reservoir with the caps $300_1$, $300_2$ secured to the respective containers $200_1$, $200_2$. Although illustrated here as separate examples, it is appreciated herein that, in some examples, multiple securing structures may be used in combination. By example, the quick-connect tube coupling 330 of FIGS. 2-3 and 9-11 may be used in combination with the clip securing structure 340 of FIGS. 12-15, thereby, providing a securing mechanism at both the tube connections and at the caps.

Each fitting is provided for attachment to an adjoining component. Such a component may be an adjacent fitting extending from a second cap, a water supply, a dispensing unit, or the like. As shown in FIG. 3, an inlet fitting $326_1$ of the first cap $300_1$ is secured to an inlet tube 700, where the inlet tube 700 may extend from a water supply or other component in the water distribution system. The outlet fitting $328_2$ of the second cap $300_2$ is attached to an outlet tube 710, where the outlet tube 710 may extend to a water dispenser or other component in the water distribution system. In some examples, the outlet fitting of the first cap may not be directly attached to the inlet fitting of the second cap but, instead, may be connected by way of an intermediate tube, fitting, or other known connection. Any number of caps and bottles may be connected together in the manner described above for increased capacity and/or flexibility in the reservoir system. A daisy-chain structure of any number of caps may be formed by connecting multiple caps by way of an inlet fitting of one cap to an outlet fitting of an adjacent cap. The first cap and the last cap, in a ganged or daisy-chained relationship, may then extend to a water supply and/or a water dispenser, or any component there between, respectively. This completes the water distribution system when it is in place within an appliance. The corresponding vessel structures may then be attached to the corresponding cap, by way of the neck, to provide a ganged reservoir system with a plurality of containers secured through their respective caps.

As illustrated by FIGS. 4-8, each cap, as illustrated by the first cap $300_1$, comprises an inlet passageway $400_1$ and an outlet passageway $500_1$. The inlet passageway $400_1$ and the outlet passageway $500_1$ extend from cap inlet $420_1$ to the container inlet $410_1$ and from the cap outlet $520_1$ to the container outlet $520_2$, respectively. The inlet passageway $400_1$ and the outlet passageway $500_1$ each form independent fluid passageways through the cap for fluid transfer through the daisy-chain structure and/or between each container of the ganged reservoir system. An example of the direction of flow is illustrated by the flow arrows illustrated within the inlet and outlet passageways of FIG. 8.

A dip tube 600 may also be provided. As illustrated by FIG. 3, a dip tube $600_1$ is in fluid communication with the container outlet $510_1$ (as illustrated by FIG. 8), where an end of the dip tube 600 is located in the container outlet $510_1$. The dip tube $600_1$ extends into the interior of the vessel structure $210_1$. The dip tube $600_1$ may extend the entire length of the vessel structure $210_1$ or a partial length of the vessel structure $210_1$. The dip tube $600_1$ may be frictionally inserted into the container outlet $510_1$. In some examples, the container outlet and the dip tube may be a contiguous structure. A second dip tube $600_2$ may also extend into and from the container outlet $510_1$ of the second cap $300_2$. In the vertical orientation of the reservoir 100 as shown in FIG. 3, water enters the first container $200_1$ from inlet tube 700. Water already in the first container $200_1$, which has been chilled, is located at the bottom of the first container $200_1$.

As the non-chilled water enters from the inlet tube 700 at the top of the first container $\mathbf{200}_1$, the chilled water exits the first container $\mathbf{200}_1$ through the dip tube $\mathbf{600}_1$ at the bottom of the first container $\mathbf{200}_1$ and flows into the second container $\mathbf{200}_2$. Similarly, the chilled water exits the second container $\mathbf{200}_2$ through the second dip tube $\mathbf{600}_2$ at the bottom of the second container $\mathbf{200}_2$ for dispensing to a user.

In order to fill the reservoir to a desired level and subsequently dispense water in the vertical orientation shown, for example, in FIGS. 2-3, the reservoir must vent air from the containers $\mathbf{200}_1$, $\mathbf{200}_2$ while the containers fill with water to their desired level. For certain applications, the cap 300 includes an air vent 370 to allow air to vent from the first container $\mathbf{200}_1$ to the outlet tube 710. The air vent 370 connects the first container inlet $\mathbf{410}_1$ to the first container outlet $\mathbf{510}_1$ as shown in FIGS. 7-8. The air vent 370 extends above where the dip tube $\mathbf{600}_1$ engages the container outlet $\mathbf{510}_1$ as seen in FIG. 3 which permits air to vent from the container to the outlet passageway $\mathbf{500}_1$ and then ultimately to the outlet tube 710. However, for other applications, air may flow out of the containers through the outlet tube without the addition of an air vent as discussed below. Whether or not an air vent is required is determined in part by the orientation of the reservoir in its installed position, whether a dip tube is provided on the inlet or the outlet, the position of the outlet aperture and/or the end of the outlet dip tube, and other factors. For example, in FIGS. 2-3, the reservoir is oriented in an upright vertical position, and dip tubes $\mathbf{600}_1$, $\mathbf{600}_2$ are provided on each container outlet $\mathbf{510}_1$. If no air vent were provided, the reservoir would stop filling at the depth of the end of the dip tube because the air in the container would be captured.

Figure 17:
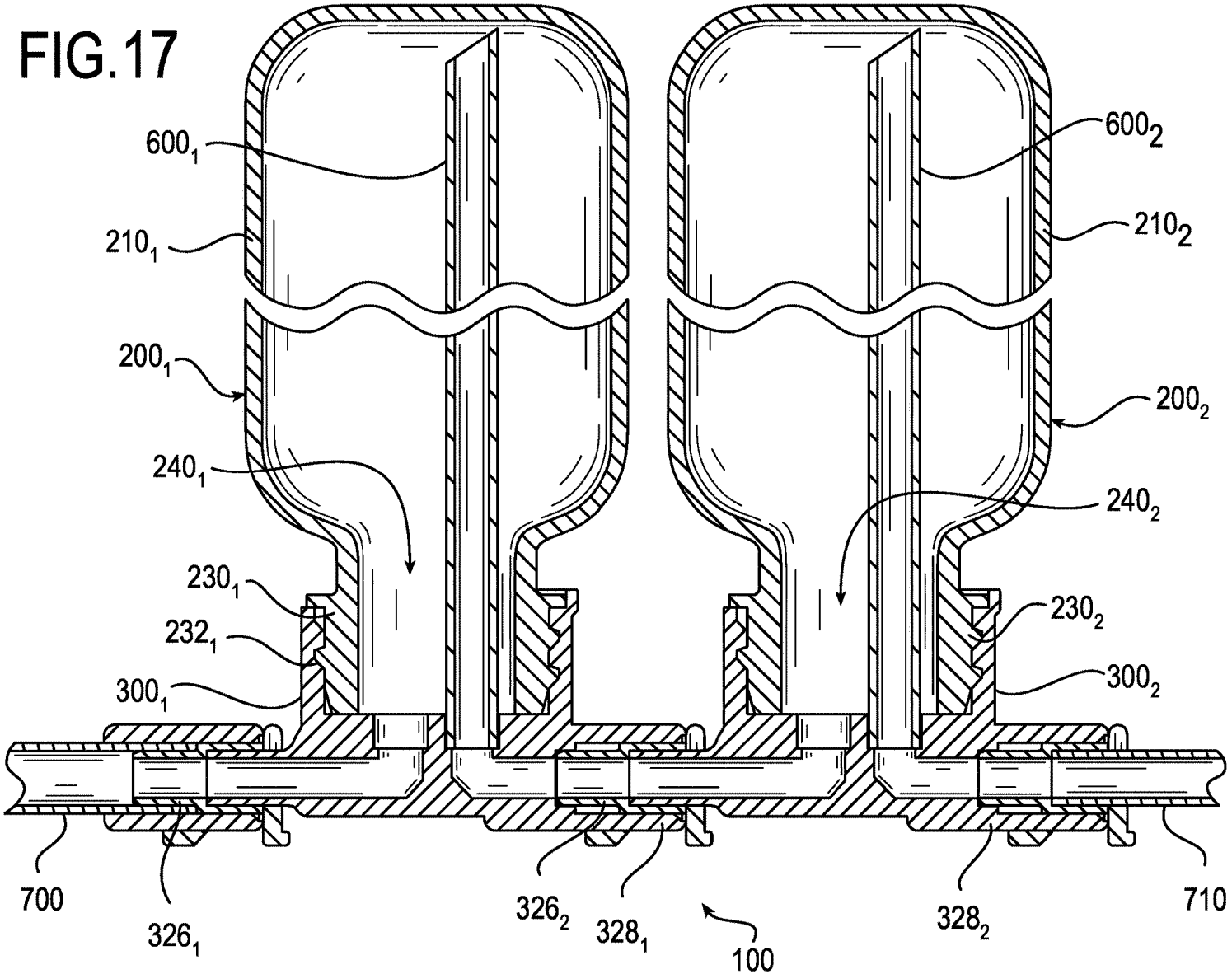
FIG. 17 is a side view of a reservoir for installation in an appliance in an inverted orientation.
Figure 18:
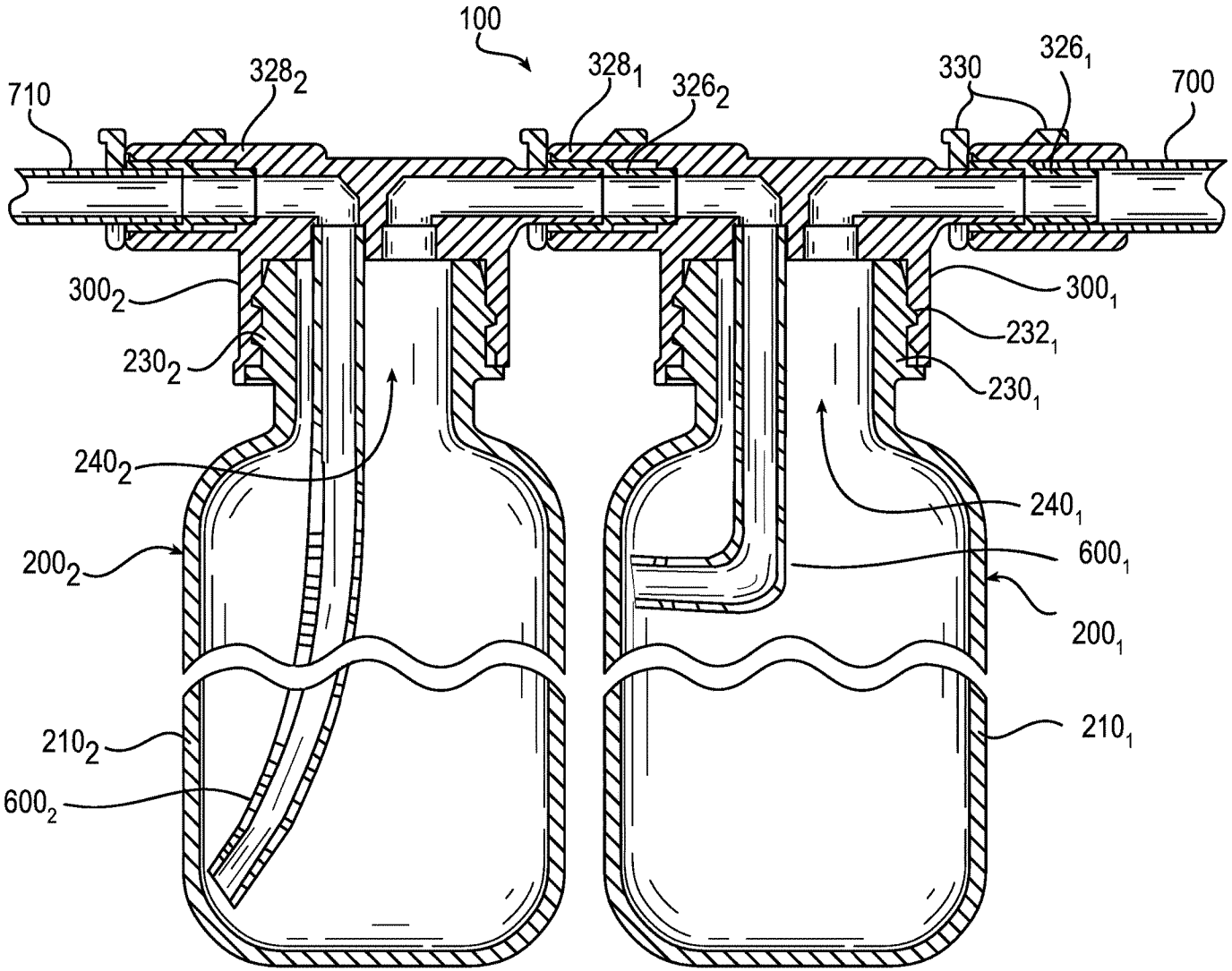
FIG. 18 is a side view of a reservoir for installation in an appliance with the vessel structures in a stacked orientation.

In an alternative embodiment, no air vent would be needed if the orientation of the reservoir was inverted (i.e. if FIG. 3 was upside down). In this example, the air would exit into the bottom of the dip tube $\mathbf{600}_1$ and out through the outlet passageway $\mathbf{500}_1$ and ultimately to the outlet tube 710. Such an example is illustrated by FIG. 17, where the features of FIG. 17 are illustrated as previously described with respect to FIG. 3. Still yet, in another example, as illustrated by FIG. 18, the vessel structures $\mathbf{210}_1$ and $\mathbf{210}_2$ may be stacked in a stacked orientation. Likewise, the dip tubes (e.g. $\mathbf{600}_1$, $\mathbf{600}_2$) may be arranged (e.g. bent) to facilitate air passage out through the outlet passageway $\mathbf{500}_1$ and ultimately to the outlet tube 710 without the use of an air vent. In one example, the dip tube $\mathbf{600}_1$ is an L-shaped dip tube. In another example, the dip tube $\mathbf{600}_2$ is curved or arched. The features of FIG. 18 are otherwise illustrated as previously described with respect to FIG. 3. These examples illustrate the various orientations or configurations, or even a combination of configurations to facilitate positioning of the reservoir within an appliance.

In the example illustrated by FIGS. 2-8, the cap forms a "T" configuration. Alternative configurations are contemplated herein. For example, the inlet fitting and the outlet fitting may be positioned at any location on the exterior surface of the cap (e.g. a perimeter, a side, a combination thereof, or the like). Moreover, the inlet fitting and the outlet fitting may be integral with one another and/or the exterior surface of the cap, or they may be separate. In one example, the cap and fittings are molded together as an integral part. In other examples, the fittings may be attached to the exterior surface of the cap by way of overmolding, a weld, adhesive, another fitting, or the like.

The container 200 may be made of polyethylene terephthalate (PET), polycarbonate, aluminum, stainless steel or other suitable material. The container 200 may be formed from a multilayer material. A barrier film may be provided in at least one layer of the multilayer material, where the barrier layer inhibits passage of one or more from the group consisting of oxygen, carbon dioxide, water vapor, molecules affecting taste, molecules affecting odor. In one example, the container 200 is an off-the-shelf bottle. The use of off-the-shelf existing bottle preforms significantly reduces the tooling expense and makes the manufacturing process of the reservoir easier, quicker, and less expensive.

In certain embodiments, the container 200 is a bottle, such as a bottle formed by injection blow molding. A bottle formed by injection blow molding may be useful in providing a strong material, such as PET, polycarbonate, or the like, at an efficient cost. In some examples, one or more of the cap, the fittings, the inlet tube, and the outlet tube are made from polymers known in the art including, but not limited to, polyethylene, polypropylene, PVC, polystyrene, nylon, polytetrafluoroethylene and thermoplastic polyurethanes.

In some examples, the reservoir, or any of the components defined above, may be made from high density polyethylene which is crosslinked, although the process described herein can be used with tubes or fittings made from any crosslinked polymers. Such polymers may include, but are not limited to, nylon, EVA, PVC, metallocine, polypropylene, polyethylene, silicone, rubber and EPDM. Crosslinked polyethylene, also known as PEX, contains crosslinked bonds in the polymer structure changing the thermoplastic into a thermoset. Crosslinking may be accomplished during or after extrusion depending on the method of crosslinking. The required degree of crosslinking for crosslinking polyethylene tubing, according to ASTM Standard F 876, is between 65-89%. However, the present process contemplates that the tube of fitting may be partially crosslinked. In one example, the tube of fitting may only be crosslinked to 40%. There are three classifications of PEX, referred to as PEX-A, PEX-B, and PEX-C. PEX-A is made by peroxide (Engel) method. In the PEX-A method, peroxide blending with the polymer performs crosslinking above the crystal melting temperature. The polymer is typically kept at high temperature and pressure for long periods of time during the extrusion process. PEX-B is formed by the silane method, also referred to as the "moisture cure" method. In the PEX-B method, silane blended with the polymer induces crosslinking during secondary post-extrusion processes, producing crosslinks between a crosslinking agent. The process is accelerated with heat and moisture. The crosslinked bonds are formed through silanol condensation between two grafted vinyltrimethoxysilane units. PEX-C is produced by application of an electron beam using high energy electrons to split the carbon-hydrogen bonds and facilitate crosslinking.

Crosslinking imparts shape memory properties to polymers. Shape memory materials have the ability to return from a deformed state (e.g. temporary shape) to their original crosslinked shape (e.g. permanent shape), typically induced by an external stimulus or trigger, such as a temperature change. Alternatively or in addition to temperature, shape memory effects can be triggered by an electric field, magnetic field, light, or a change in pH, or even the passage of time. Shape memory polymers include thermoplastic and thermoset (covalently crosslinked) polymeric materials.

Shape memory materials are stimuli-responsive materials. They have the capability of changing their shape upon application of an external stimulus. A change in shape caused by a change in temperature is typically called a thermally induced shape memory effect. The procedure for using shape memory typically involves conventionally processing a polymer to receive its permanent shape, such as by molding the polymer in a desired shape and crosslinking the polymer defining its permanent crosslinked shape. Afterward, the polymer is deformed and the intended temporary shape is fixed. This process is often called programming. The programming process may consist of heating the sample, deforming, and cooling the sample, or drawing the sample at a low temperature. The permanent crosslinked shape is now stored while the sample shows the temporary shape. Heating the shape memory polymer above a transition temperature $T_{trans}$ induces the shape memory effect providing internal forces urging the crosslinked polymer toward its permanent or crosslinked shape. Alternatively or in addition to the application of an external stimulus, it is possible to apply an internal stimulus (e.g., the passage of time) to achieve a similar, if not identical result.

A chemical crosslinked network may be formed by low doses of irradiation. Polyethylene chains are oriented upon the application of mechanical stress above the melting temperature of polyethylene crystallites, which can be in the range between 60° C. and 130° C. Materials that are most often used for the production of shape memory linear polymers by ionizing radiation include high density polyethylene, low density polyethylene and copolymers of polyethylene and poly(vinyl acetate). After shaping, for example, by extrusion or compression molding, the polymer is covalently crosslinked by means of ionizing radiation, for example, by highly accelerated electrons. The energy and dose of the radiation are adjusted to the geometry of the sample to reach a sufficiently high degree of crosslinking, and hence sufficient fixation of the permanent shape.

Another example of chemical crosslinking includes heating poly(vinyl chloride) under a vacuum resulting in the elimination of hydrogen chloride in a thermal dehydrocholorination reaction. The material can be subsequently crosslinked in an HCI atmosphere. The polymer network obtained shows a shape memory effect. Yet another example is crosslinked poly[ethylene-co-(vinyl acetate)] produced by treating the radical initiator dicumyl peroxide with linear poly[ethylene-co-(vinyl acetate)] in a thermally induced crosslinking process. Materials with different degrees of crosslinking are obtained depending on the initiator concentration, the crosslinking temperature and the curing time. Covalently crosslinked copolymers made form stearyl acrylate, methacrylate, and N,N'-methylenebisacrylamide as a crosslinker.

Additionally shape memory polymers include polyurethanes, polyurethanes with ionic or mesogenic components, block copolymers consisting of polyethyleneterephthalate and polyethyleneoxide, block copolymers containing polystyrene and poly(1,4-butadiene), and an ABA triblock copolymer made from poly(2-methyl-2-oxazoline) and a poly (tetrahydrofuran). Further examples include block copolymers made of polyethylene terephthalate and polyethylene oxide, block copolymers made of polystyrene and poly(1,4-butadiene) as well as ABA triblock copolymers made from poly(tetrahydrofuran) and poly(2-methyl-2-oxazoline). Other thermoplastic polymers which exhibit shape memory characteristics include polynorbornene, and polyethylene grated with nylon-6 that has been produced for example, in a reactive blending process of polyethylene with nylon-6 by adding maleic anhydride and dicumyl peroxide.

The terms "comprising," "including," and "having," as used in the claims and specification herein, shall be considered as indicating an open group that may include other elements not specified. The terms "a," "an," and the singular form of words shall be taken to include the plural form of the same words, such that the terms mean that one or more of something is provided. The terms "at least one" and "one or more" are used interchangeably. The terms "preferably," "preferred," "prefer," "optionally," "may," and similar terms are used to indicate that an item, condition or step being referred to is an optional (i.e., not required) feature of the embodiments.

While the present disclosure has been described with reference to examples thereof, it shall be understood that such description is by way of illustration only and should not be construed as limiting the scope of the claimed examples. Accordingly, the scope and content of the examples are to be defined only by the terms of the following claims. Furthermore, it is understood that the features of any example discussed herein may be combined with one or more features of any one or more examples otherwise discussed or contemplated herein unless otherwise stated.

What is claimed is:

1. A ganged reservoir system for use in a water distribution system within an appliance, the ganged reservoir system comprising:

a first container in fluid communication with a second container, each container including a vessel structure terminating at a neck around an opening;

a cap sealingly engaging the neck of each container, the cap comprising: a cap fitting structure, an inlet fitting and an outlet fitting, where the cap fitting structure, the inlet fitting and the outlet fitting are integral to define a one-piece connection;

an inlet tube attached to the inlet fitting of the cap of the first container;

an outlet tube attached to the outlet fitting of the cap of the second container;

where the outlet fitting of the cap of the first container abuts the inlet fitting of the cap of the second container;

the cap further comprising:

an internal surface;

an external surface opposite the internal surface;

a container inlet proximal the internal surface, the container inlet including a container inlet axis;

a container outlet proximal the internal surface, the container outlet including a container outlet axis;

where the container inlet axis is parallel to the container outlet axis;

where the container inlet axis is transverse to the cap inlet axis; and where the container outlet axis is transverse to the cap outlet axis.

2. The ganged reservoir system of claim 1, the inlet fitting including a cap inlet, the cap inlet including a cap inlet axis, and the outlet fitting including a cap outlet, the cap outlet including a cap outlet axis, where the cap inlet axis and the cap outlet axis are coaxial.

3. The ganged reservoir system of claim 2, where the container inlet axis is substantially perpendicular to the cap inlet axis and the container outlet axis is substantially perpendicular to the cap outlet axis.

4. The ganged reservoir system of claim 1 further comprising a threaded connection between the cap and the neck to advance the cap toward and away from a base of the neck.

5. The ganged reservoir system of claim 4 further comprising a seal positioned above the threaded connection between the cap and the neck.

6. The ganged reservoir system of claim 5 where the seal is an o-ring.

7. The ganged reservoir system of claim 1 where the cap is removably engaged with the neck.

8. The ganged reservoir system of claim 1 where the inlet fitting is either a male fitting or a female fitting integral with an exterior surface of the cap.

9. The ganged reservoir system of claim 1 where the outlet fitting is either a male fitting or a female fitting integral with an exterior surface of the cap.

10. The ganged reservoir system of claim 1 where the inlet fitting and the outlet fitting of each cap are molded together and integral with one another.

11. A ganged reservoir system for use in a water distribution system within an appliance, the ganged reservoir system comprising:

a first container in fluid communication with a second container, each container including a vessel structure terminating at a neck around an opening;

a cap sealingly engaging the neck of each container, the cap comprising: an inlet fitting and an outlet fitting;

an inlet tube attached to the inlet fitting of the cap of the first container;

an outlet tube attached to the outlet fitting of the cap of the second container;

where the outlet fitting of the cap of the first container abuts the inlet fitting of the cap of the second container;

the cap further comprising:

an internal surface;

an external surface opposite the internal surface;

a container inlet proximal the internal surface, the container inlet including a container inlet axis;

a container outlet proximal the internal surface, the container outlet including a container outlet axis;

where the container inlet axis is parallel to the container outlet axis; and an air vent connecting the container inlet to the container outlet on the internal surface of the cap.

12. A daisy-chain structure for connecting a first container and a second container to form a ganged reservoir system within an appliance, the daisy-chain structure comprising:

at least a first cap and a second cap, the first cap configured to attach to the first container and the second cap configured to attach to the second container, each of the first cap and the second cap comprising:

a cap fitting structure;

an inlet fitting and an outlet fitting;

where the cap fitting structure, the inlet fitting and the outlet fitting are integral to define a one-piece connection;

where the outlet fitting of the first cap of the first container abuts the inlet fitting of the second cap of the second container;

an internal surface;

an external surface opposite the internal surface;

a container inlet proximal the internal surface, the container inlet including a container inlet axis;

a container outlet proximal the internal surface, the container outlet including a container outlet axis;

where the container inlet axis is parallel to the container outlet axis;

wherein the container inlet axis is transverse to the cap inlet axis; and where the container outlet axis is transverse to the cap outlet axis.

13. The ganged reservoir system of claim 12, the inlet fitting including a cap inlet, the cap inlet including a cap inlet axis, and the outlet fitting including a cap outlet, the cap outlet including a cap outlet axis, where the cap inlet axis and the cap outlet axis are coaxial.

14. The ganged reservoir system of claim 13, where the container inlet axis is substantially perpendicular to the cap inlet axis and where the container outlet is substantially perpendicular to the cap outlet axis.

* * * * *